United States Patent [19]

Biseröd

[11] 4,167,140

[45] Sep. 11, 1979

[54] PROJECTILE FOR SCATTERING OF A LOAD

[75] Inventor: Hans B. Biseröd, Raufoss, Norway

[73] Assignee: A/S Raufoss Ammunisjonsfabrikker, Raufoss, Norway

[21] Appl. No.: 827,067

[22] Filed: Aug. 23, 1977

[30] Foreign Application Priority Data

Aug. 24, 1976 [NO] Norway ..... 762908

[51] Int. Cl.[2] ..... F42B 13/14

[52] U.S. Cl. ..... 102/66; 102/37.6; 102/89 CD; 102/90

[58] Field of Search ..... 102/34.4, 35.6, 37.6, 102/66, 67, 69, 90, 92.6, 89 CD; 42/76 A

[56] References Cited

U.S. PATENT DOCUMENTS

| | | | |
|---|---|---|---|
| 2,276,110 | 3/1942 | Snelling | 102/67 |
| 2,736,118 | 2/1956 | Clarkson et al. | 42/76 A |
| 3,027,672 | 4/1962 | Sullivan | 42/76 A |
| 3,750,575 | 8/1973 | Heede | 102/69 |
| 3,893,814 | 7/1975 | McGhee | 102/90 |
| 3,983,820 | 10/1976 | Crepin | 102/92.6 |

*Primary Examiner*—Verlin R. Pendegrass
*Attorney, Agent, or Firm*—Watson, Cole, Grindle & Watson

[57] ABSTRACT

A projectile contains a load to be ejected therefrom during a flight and includes a one-piece casing having a streamlined outer surface and having a portion containing the load. The casing has a reduced wall thickness at a section of such portion, and a metallic liner is cast onto the inner wall of the casing at such section, the liner having an inner diameter substantially equal to the inner diameter of the remainder of the casing at such portion. An external guide ring on the casing is located on the greater wall thickness thereof, and projections on the inner wall of the casing at such section engage grooves provided in the liner.

4 Claims, 1 Drawing Figure

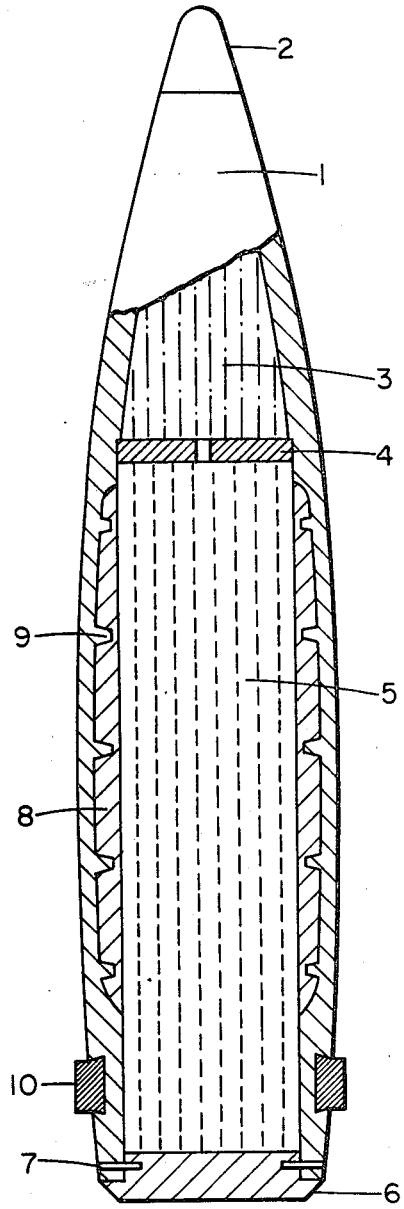
2
1
3
4
9
5
8
10
7
6

PROJECTILE FOR SCATTERING OF A LOAD

This invention relates to a projectile for the scattering of a load for specific purposes, such as a light emitting or smoke producing material or a material for reflecting radar waves (chaff). The load is to be ejected from the projectile during flight, for instance by means of an ejector charge which is ignited with a certain delay relative to the moment of firing of the projectile. Also a mechanical ejector device comprising, for instance, a spring might be used. The load may be connected to a parachute adapted to keep the load suspended in the air while emitting light or producing smoke.

The projectile is adapted to be fired from a gun, cannon or the like, and the projectile is to have a streamlined outer shape and to a large extent correspond to live projectiles with respect to shape, weight and weight distribution. This is of importance for making it possible to calculate the path of flight for the projectile in the same manner as if it were a live projectile. In this type of projectile it is desirable to locate the largest possible amount of load under the above-mentioned conditions. A primary problem arising is how to produce a projectile casing having the lowest possible weight, the largest possible inner space for the load and sufficient strength to withstand the large mechanical strains during firing of the projectile. The strains are caused by the immense acceleration, linear and rotational (as when using a gun with a rifled bore). The linear acceleration will usually amount to several thousand times the gravity acceleration.

A known principle to achieve an increased space for the load is to provide a minor wall thickness in parts of the projectile where this can be done without causing excessive strains. Provision of thin wall areas, however, leads to particular problems, because the space for the load must be defined by straight generatrices lengthwise of the projectile and in the entire length of the space. This could be achieved by forming the projectile as a tube with a mounted nose. The tube, however, should have to be rather thickwalled when the projectile is to be launched by use of a cannon, as a guiding and force transferring ring is provided around the projectile, preferably on the rear half thereof. Through this ring, which is deformed by the rifles during launching, is transferred a considerable radial pressure and axial thrust force exerted by the gas in the bore of the cannon. The wall thickness must be sufficient to withstand the transferred forces. Provided that the inner load in the projectile is to pass the area of the ring when being ejected, the strength properties of this area will be decisive for the largest possible diameter of the space for the load. This results in that the casing will be thickwalled and heavy.

A known way to solve this problem is to make the casing from two parts being interconnected along a plane in a direction across the projectile. The load is then ejected by opening the interconnection. The load space may then have a diameter which exceeds the diameter in the critical area. From British Pat. No. 1,345,820 is known a projectile designed in the above manner.

A disadvantage in the described solution lies in the interconnection between the parts. The production will be expensive due to the necessary machine working of the parts and possible sub parts, and there may be strength problems in the interconnection area, particularly when the interconnection is situated in a thin-walled portion of the projectile.

The main object of this invention is to provide a projectile of the type mentioned, in which the casing is made from one piece and has a low weight, while avoiding the disadvantages mentioned.

According to the invention the casing is provided with inner projections in the area of the liner.

Thus, there is achieved a projectile casing which does not exhibit weakened areas caused by an interconnection between two parts, and the projections will contribute substantially in preventing the liner from moving relative to the casing.

The main purpose of projections, formed as ribs or of another shape, is to prevent fractures in the liner caused by the inertia forces during firing. These forces will be very large, and without projections the rear part of the liner should, when friction is disregarded, have to carry the considerably increased weight of the front part. Thus, there is a great probability that the compressive forces exerted on the rear part of the liner will be excessive. The provision of projections preferably spaced along the entire length of the liner, will act as a suspension for the liner.

There are several possible shapes for the projections. There will usually be a need for working the inner surface of the casing with a cutting tool, and the projections may preferably have the shape of annular ribs.

The casting of a liner of light metal inside a casing of steel leads to a particular difficulty, because of the individually different coefficients of thermal expansion of light metals and steel. Light metals have the largest coefficient, and will consequently have the largest contraction after solidifying. This causes a radial clearance between the casing and the liner after cooling. However, the provision of projections contributes in securing the liner despite this radial clearance, because the excessive contraction of the liner longitudinally of the projectile will press the liner against the sides of the projections. Assuming that the longitudinal middle part of the liner is kept longitudinally immovable relative to the casing during the cooling, both ends of the liner will move towards the middle.

The invention will now be described by way of example with reference to the accompanying drawing.

The casing 1 of the projectile contains a fuse 2 in the nose portion, for igniting of the ejector charge 3. Instead of a fuse for instance a charge of gunpowder may be used. Behind the ejector charge 3 is a disc 4 defining a piston. The load 5, which may have any of the functions described, is provided in a cylindrical space which is closed by means of a base 6, secured in position by shear pins 7. The load may possibly be encased in a thin jacket. The larger part of the wall thickness of the wall surrounding the load space is constituted by the liner 8 of light metal. The liner 8 does not extend in the area of the casing carrying the guiding ring 10.

The liner 8 is secured by means of projections, for instance ribs 9, on the inner surface of the casing.

The liner 8 may preferably consist of aluminum, magnesium or an alloy based on these metals.

According to a method of producing the projectile the liner is cast inside the casing, preferably by centrifugal casting. Advantageously, the liner is cast with a sufficiently small inner diameter so as to permit the necessary working of the surface.

According to the method the casing may be preheated before the casting of the liner, preferably to a temperature near the melting point of the light metal. This will reduce the effect of the different coefficients of thermal expansion of the casing and the liner, respectively.

I claim:

1. A projectile containing a load to be ejected therefrom during flight, comprising, a one-piece elongated casing having a streamlined outer surface and having a portion defining a space containing the load, a removable base enclosing the space and being adapted for removal or break up during ejection of the load, such ejection capable of being effected by an ejector charge or a mechanical device with a delay relative to the moment of firing the projectile, said casing being of steel material and having a first wall thickness along a section of said portion which is less than the wall thickness at the remainder of said portion, a metallic cylindrical liner at said section in engagement with an inner wall of said casing, said liner being of a material of less weight relative to said steel material, said liner having an inner diameter substantially equal to an inner diameter of said remainder of said casing portion containing the load, an external guide ring on said casing at a location of greater wall thickness relative to said first wall thickness, and an outer surface of said liner and said inner wall of said casing having interengaging projections and grooves disposed transversely of said casing, whereby any weakened areas caused by an interconnection between two parts of said casing are avoided by said one-piece casing thereby assuring ejection of the load through said removable base, and whereby said interengaging projections and grooves prevent said liner from moving longitudinally relative to said casing to thereby avoid any fractures in said liner caused by inertia forces during firing.

2. The projectile according to claim 1, wherein said projections are defined by spaced annular ribs.

3. The projectile according to claim 1, wherein said liner is of an aluminum material.

4. The projectile according to claim 1, wherein said liner is of a magnesium material.

* * * * *